US010226112B2

(12) United States Patent
Kerr et al.

(10) Patent No.: US 10,226,112 B2
(45) Date of Patent: Mar. 12, 2019

(54) HAND HELD APPLIANCE

(71) Applicant: Dyson Technology Limited, Wiltshire (GB)

(72) Inventors: Thomas James Kerr, Gloucester (GB); Christopher William Hedges, Guildford (GB); Robert Mark Brett Coulton, Bristol (GB); Adam James Bates, Oxford (GB); Andrea Ee-Va Lim, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 247 days.

(21) Appl. No.: 14/971,910

(22) Filed: Dec. 16, 2015

(65) Prior Publication Data

US 2016/0166033 A1 Jun. 16, 2016

(30) Foreign Application Priority Data

Dec. 16, 2014 (GB) ..... 1422355.6

(51) Int. Cl.
*A45D 20/04* (2006.01)
*A45D 20/10* (2006.01)
(Continued)

(52) U.S. Cl.
CPC ..... *A45D 20/04* (2013.01); *A45D 20/10* (2013.01); *A45D 20/12* (2013.01); *A47G 29/141* (2013.01); *A47G 2029/146* (2013.01)

(58) Field of Classification Search
CPC ..... A45D 20/04; A45D 20/10; A45D 20/12; A45D 29/141; A45D 2029/146; A47G 29/141; A47G 2029/146
(Continued)

(56) References Cited

U.S. PATENT DOCUMENTS 4,936,027 A 6/1990 Tsuji
D715,996 S 10/2014 Dyson et al.
(Continued)

FOREIGN PATENT DOCUMENTS

EP 0827702 A2 * 3/1998 ..... A45D 20/12
EP 2 002 752 12/2008
(Continued)

OTHER PUBLICATIONS

Search Report dated May 26, 2015, directed to GB Application No. 1422355.6; 1 page.
(Continued)

*Primary Examiner* — Jessica Yuen
(74) *Attorney, Agent, or Firm* — Morrison & Foerster LLP

(57) ABSTRACT

A hand held appliance including a handle having an outer wall, an inner structure disposed within the outer wall and an end wall extending across the outer wall wherein the end wall is attached to the handle via the inner structure and the end wall extends away from the outer wall. The handle may have a longitudinal axis along which the outer wall extends; the end wall may extend away from the outer wall towards the longitudinal axis. The end wall may extend from the outer wall towards the longitudinal axis as the end wall extends away from the outer wall and may taper as it extends away from the outer wall. The end wall may be frustoconical in shape. The end wall may include at least one first attachment member that extends from the end wall to engage with one or more cooperating attachment members of the inner structure.

25 Claims, 9 Drawing Sheets

(51) Int. Cl.
*A45D 20/12* (2006.01)
*A47G 29/14* (2006.01)

(58) Field of Classification Search
USPC ..... 34/96, 97
See application file for complete search history.

(56) References Cited

U.S. PATENT DOCUMENTS

| | | | | |
|---|---|---|---|---|
| 2002/0092196 | A1 | 7/2002 | Tobin et al. | |
| 2010/0071223 | A1* | 3/2010 | Ha | A45D 20/12 34/97 |
| 2014/0208605 | A1* | 7/2014 | Yoshidome | A45D 20/12 34/97 |

FOREIGN PATENT DOCUMENTS

| | | |
|---|---|---|
| EP | 2 497 385 | 9/2012 |
| FR | 2 907 642 | 5/2008 |
| JP | 48-74171 | 9/1973 |
| JP | 58-180104 | 10/1983 |
| JP | 58-180107 | 10/1983 |
| JP | 59-186505 | 10/1984 |
| JP | 59-193302 | 12/1984 |
| JP | 59-228806 | 12/1984 |
| JP | 60-215305 | 10/1985 |
| JP | 61-73606 | 4/1986 |
| JP | 61-86102 | 6/1986 |
| JP | 61-86103 | 6/1986 |
| JP | 64-46406 | 2/1989 |
| JP | 1-101914 | 4/1989 |
| JP | 2-295509 | 12/1990 |
| JP | 6-38823 | 2/1994 |
| JP | 6-38829 | 2/1994 |
| JP | 6-38805 | 5/1994 |
| JP | 6-237815 | 8/1994 |
| JP | 7-136013 | 5/1995 |
| JP | 7-222618 | 8/1995 |
| JP | 7-47048 | 11/1995 |
| JP | 2003-153731 | 5/2003 |
| KR | 10-1415326 | 7/2014 |
| WO | WO-2015/044646 | 4/2015 |

OTHER PUBLICATIONS

International Search Report and Written Opinion dated Feb. 9, 2016, directed to International Application No. PCT/GB2015/053575; 15 pages.

* cited by examiner

HAND HELD APPLIANCE

REFERENCE TO RELATED APPLICATIONS

This application claims the priority of United Kingdom Application No. 1422355.6, filed Dec. 16, 2014, the entire contents of which are incorporated herein by reference.

FIELD OF THE INVENTION

This invention relates to a hand held appliance and in particular a hair care appliance such as a hairdryer.

BACKGROUND OF THE INVENTION

Generally, a motor and fan are provided which draw fluid into a body; the fluid may be heated prior to exiting the body. The motor is susceptible to damage from foreign objects such as dirt or hair so conventionally a filter is provided at the fluid inlet to the blower. The fan and heater require power in order to function and this is provided via internal wiring from either a mains power cable or batteries attached to the appliance.

SUMMARY OF THE INVENTION

According to a first aspect, the invention provides a hand held appliance comprising a housing having an outer wall, an inner structure disposed within the outer wall and an end wall extending across the outer wall wherein the end wall is attached to the housing via the inner structure Preferably, the end wall extends away from the outer wall.

Preferably, the housing has a longitudinal axis along which the outer wall extends. It is preferred that the end wall extends along the longitudinal axis. Preferably, the end wall extends away from the outer wall towards the longitudinal axis; the end wall extends from the outer wall towards the longitudinal axis as the end wall extends away from the outer wall.

The inner structure is preferably housed within the outer wall and spaced from the outer wall. The inner structure is preferably mechanically connected to the outer wall via the end wall.

Preferably, the end wall tapers as it extends away from the outer wall. It is preferred that the end wall is frustoconical in shape.

It is preferred that the end wall is formed from two parts, a first part which engages with the inner structure and a second part which is held against the outer wall by the first part. Preferably, the first part is rotatable relative to the second part. It is preferred that the first part is rotatable relative to the inner structure to engage the end wall with respect to the housing. Preferably, the housing has an oval cross-section.

Preferably, the end wall comprises a first attachment member and the first attachment member extends from the end wall to engage with a cooperating attachment member of the inner structure.

Preferably, one of the first attachment member and cooperating member comprises a groove into which a cooperating protrusion of the other of the first attachment member and cooperating member extends when the end wall is attached to the inner structure of the appliance.

It is preferred that the end wall is turned or rotated with respect to the inner structure to attach the end wall to the inner structure. In this embodiment, the groove and protrusion are preferably helical. Thus, as the end wall is twisted into position the end wall moves towards the outer wall of the handle.

Alternatively, the end wall is pushed towards the handle to attach the end wall to the inner structure.

In a preferred embodiment, the end wall comprises an aperture. Preferably, the aperture extends centrally though the end wall.

Preferably, the aperture is defined by an inner wall which preferably extends internally of the end wall.

Preferably, a power cable for providing power to the appliance extends through the aperture into a retaining housing. Having a curved or cone shaped inner wall allows the cable to move with respect to the appliance without placing undue stress on the power cable.

Preferably, the first attachment member comprises a protrusion and cooperating member comprises a recess wherein when the end wall is attached to the inner structure the protrusion protrudes into the recess. In a preferred embodiment, the first attachment member comprises a pair of protrusions.

Preferably, one of the pair or protrusions protrudes into one side of the recess and the other of the pair of protrusions protrudes into the other side of the recess.

Preferably, the inner structure comprises a rib that extends radially out from the inner structure. Preferably, the rib comprises the recess.

In a preferred embodiment, the end wall forms part of a filter unit and the filter unit additionally comprises a mesh filter, a filter frame surrounding the periphery of the mesh filter wherein the filter frame extends from the end wall.

Preferably, the end wall is non-continuous around the inner structure.

According to a second aspect, the invention provides a hand held appliance comprising a housing having an outer wall, an inner structure disposed within the outer wall and a filter unit wherein the filter unit comprises an end wall extending across the outer wall, a mesh filter extending from the end wall and a filter frame surrounding the periphery of the mesh filter wherein the end wall is attached to the housing via the inner structure.

Preferably, the inner structure comprises a pair of attachment features having angled faces.

It is preferred that the angled faces are located one on each side of a rib that extends radially out from the inner structure and along at least part of the inner structure wherein the angled faces are angled towards the rib in a direction extending away from the end wall.

Preferably, the end wall comprises a pair of attachment features having angled faces wherein the end wall angled faces are oppositely angled to the inner structure angled faces.

It is preferred that the wherein the end wall, mesh filter and filter frame are non-continuous around the inner structure.

Preferably, the inner structure comprises a rib that extends radially out from the inner structure and along at least part of the inner structure.

It is preferred that the filter frame abuts the rib on either side of the rib when the end wall is attached to the inner structure.

Preferably, the rib comprises a recess extending partially along the rib.

It is preferred that the filter frame comprises a pair of protrusions wherein when the end wall is attached to the inner structure, the protrusions protrude into the recess.

Preferably, as the filter unit is inserted into the housing the filter frame is pushed towards the rib by the attachment features.

Preferably, the end wall is pushed towards the handle to attach the end wall to the inner structure.

Preferably, the end wall comprises an outer edge and when the end wall has been attached to the inner structure, the outer edge is adjacent to the outer wall or abuts the outer wall.

Preferably, the end wall comprises a lip that extends inside the outer wall when the end wall is attached.

In a preferred embodiment, the lip that extends inside the outer wall of the when the end wall has been attached to the appliance.

Preferably, the outer edge forms a mating face for an end face of the outer wall. The outer edge of the end wall extends across the end wall of the handle so an outer diameter of the handle is substantially the same as that of the end wall where the end wall meets the outer wall.

It is preferred that the housing is a handle.

Preferably, the appliance is a hair care appliance.

Preferably, the hair care appliance is a hairdryer. Alternatively, the hair care appliance is a hot styling appliance.

BRIEF DESCRIPTION OF THE DRAWINGS

The invention will now be described, by way of example only, with reference to the accompanying drawings, in which.

DETAILED DESCRIPTION OF THE INVENTION

Figure 1:
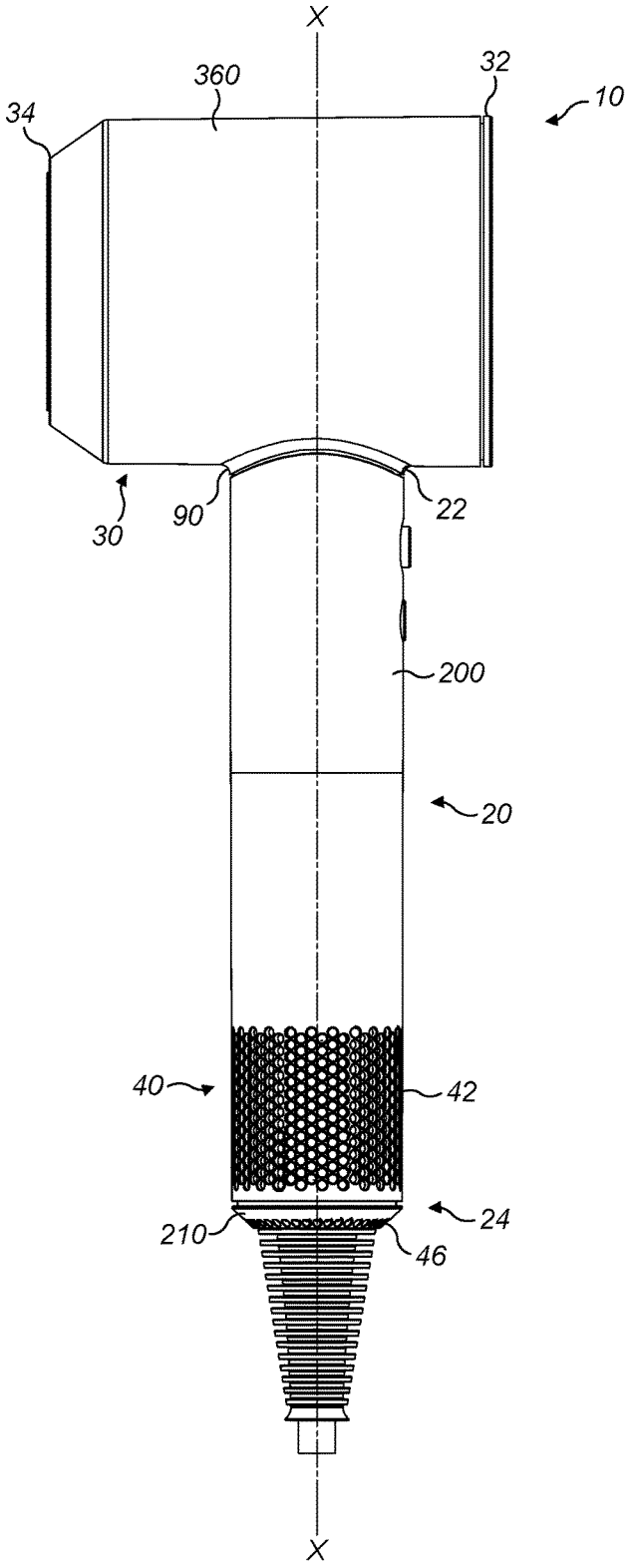
FIG. 1 shows a hairdryer according to the invention.
Figure 2:
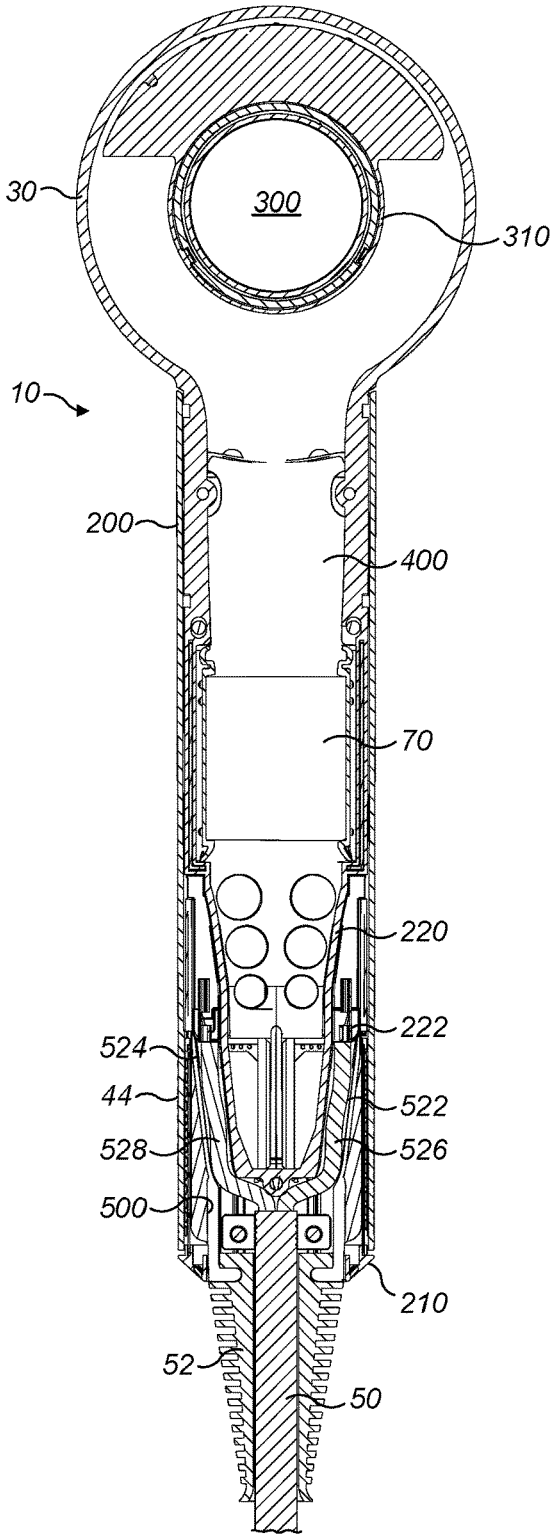
FIG. 2 shows a cross section through the hairdryer of FIG. 1.

FIGS. 1, 2, 3*a* and 3*b* show a hairdryer 10 with a handle 20 and a body 30. The handle has a first end 22 which is connected to the body 30 and a second end 24 distal from the body 30 and which includes a primary fluid inlet 40. Power is supplied to the hairdryer 10 via a cable 50. At a distal end of the cable 50 from the hairdryer 10 a plug (not shown) is provided, the plug may provide electrical connection to mains power or to a battery pack for example.

The handle 20 has an outer wall 200 which extends from the body 30 to a distal end 24 of the handle. At the distal end 24 of the handle an end wall 210 extends across the outer wall 200. The cable 50 enters the hairdryer through this end wall 210. The primary fluid inlet 40 in the handle 20 includes first apertures that extend around and along 42 the outer wall 200 of the handle and second apertures that extend across 46 and through the end wall 210 of the handle 20. The cable 50 is located approximately in the middle of the end wall 210 so extends from the centre of the handle 20. The handle 20 has a longitudinal axis X-X along which the outer wall 200 extends from the body 30 towards the distal end 24. The apertures 42, 46 are approximately 2 mm in diameter.

It is preferred that the cable 50 extends centrally from the handle 20 as this means the hairdryer is balanced regardless of the orientation of the handle 20 in a users' hand. Also, if the user moves the position of their hand on the handle 20 there will be no tugging from the cable 50 as it does not change position with respect to the hand when the hand is moved. If the cable were offset and nearer one side of the handle then the weight distribution of the hairdryer would change with orientation which is distracting for the user.

The cable 50 engages with an inner structure 500 which retains the cable 50 within the handle 20. Filter media is provided between the outer wall 200 and the inner structure 500. The filer media filters fluid that enters the through the fluid inlet 40.

Upstream of the primary fluid inlet 40, a fan unit 70 is provided. The fan unit 70 includes a fan and a motor. The fan unit 70 draws fluid through the primary fluid inlet 40 towards the body 30 through a primary fluid flow path 400 that extends from the primary fluid inlet 40 and into the body 30 where the handle 20 and the body 30 are joined 90. The body 30 has a first end 32 and a second end 34, the primary fluid flow path 400 continues through the body 30 towards the second end 34 of the body, around a heater 80 and to a primary fluid outlet 440 where fluid that is drawn in by the fan unit exits the primary fluid flow path 400. The primary fluid flow path 400 is non linear and flows through the handle 20 in a first direction and through the body 30 in a second direction which is orthogonal to the first direction.

The body 30 includes an outer wall 360 and an inner duct 310. The primary fluid flow path 400 extends along the body from the junction 90 of the handle 20 and the body 30 between the outer wall 360 and the inner duct 310 towards the primary fluid outlet 440 at the second end 34 of the body 30.

Another fluid flow path is provided within the body; this flow is not directly processed by the fan unit or the heater but is drawn into the hairdryer by the action of the fan unit producing the primary flow through the hairdryer. This fluid flow is entrained into the hairdryer by the fluid flowing through the primary fluid flow path 400.

The first end 32 of the body includes a fluid inlet 320 and the second end 34 of the body includes a fluid outlet 340. Both the fluid inlet 320 and the fluid outlet 340 are at least partially defined by the inner duct 310 which is an inner wall of the body 30 and extends within and along the body. A fluid flow path 300 extends within the inner duct 310 from the fluid inlet 320 to the fluid outlet 340. At the first end 32 of the body 30, a side wall 350 extends between the outer wall 360 and the inner duct 310. This side wall 350 at least partially defines the fluid inlet 320. The primary fluid outlet 440 is annular and surrounds the fluid flow path.

A printed circuit board (PCB) 75 including the control electronics for the hairdryer is located in the body 30 near the side wall 350 and fluid inlet 320. The PCB 75 is ring shaped and extends round the inner duct 310 between the inner duct 310 and the outer wall 360. The PCB 75 is in fluid communication with the primary fluid flow path 400. The PCB 75 extends about the fluid flow path 300 and is isolated from the fluid flow path 300 by the inner duct 310.

The PCB 75 controls parameters such as the temperature of the heater 80 and the speed of rotation of the fan unit 70. Internal wiring (not shown) electrically connects the PCB 75 to the heater 80 and the fan unit 70 and the cable 50. Control buttons 62, 64 are provided and connected to the PCB 75 to enable a user to select from a range of temperature settings and flow rates for example.

In use, fluid is drawn into the primary fluid flow path 400 by the action of the fan unit 70, is optionally heated by the heater 80 and exits from the primary fluid outlet 440. This processed flow causes fluid to be entrained into the fluid flow path 300 at the fluid inlet 320. The fluid combines with the processed flow at the second end 34 of the body. In the example shown in FIG. 3*a*, the processed flow exits the primary fluid outlet 440 and the hairdryer as an annular flow which surrounds the entrained flow that exits from the hairdryer via the fluid outlet 340. Thus fluid that is processed by the fan unit and heater is augmented by the entrained flow.

Figure 3A:
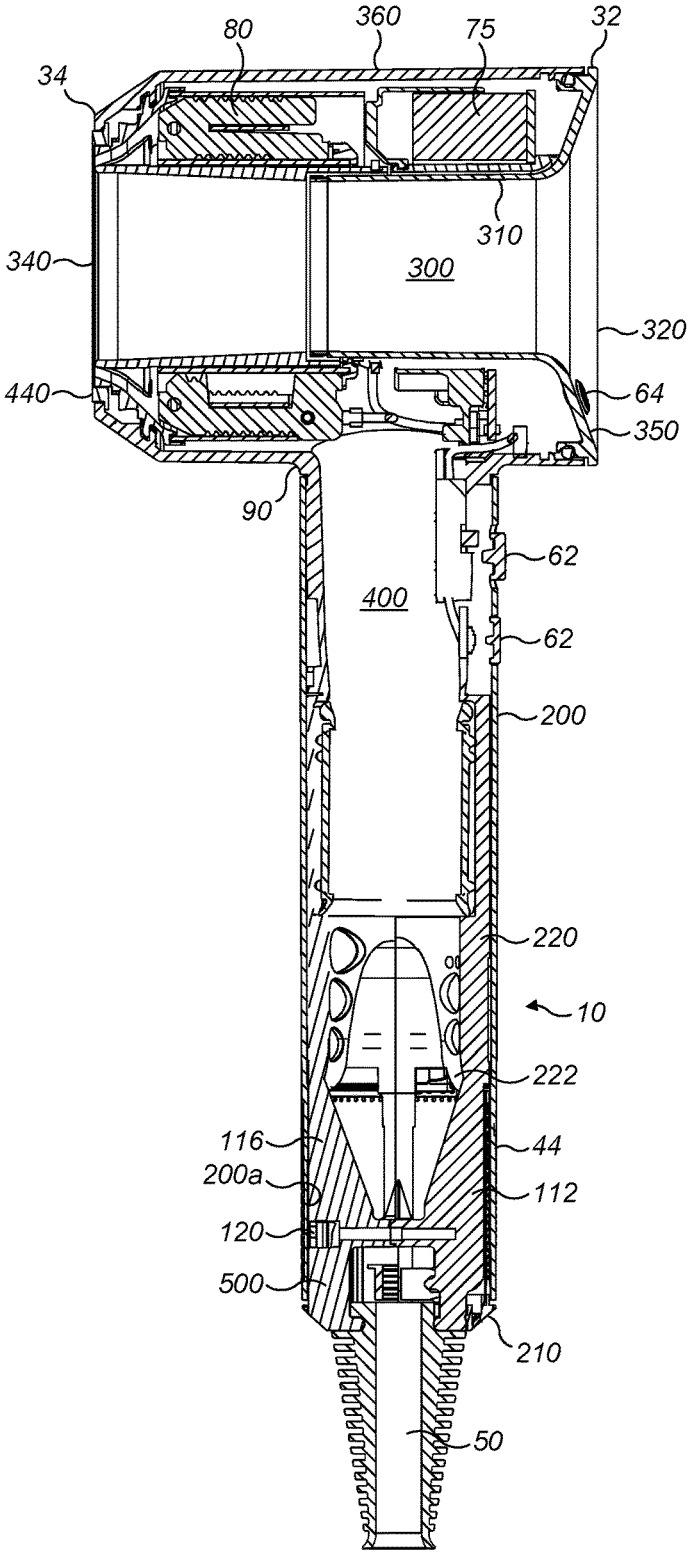
FIG. 3*a* shows a further cross section through the hairdryer of FIG. 1.
Figure 3B:
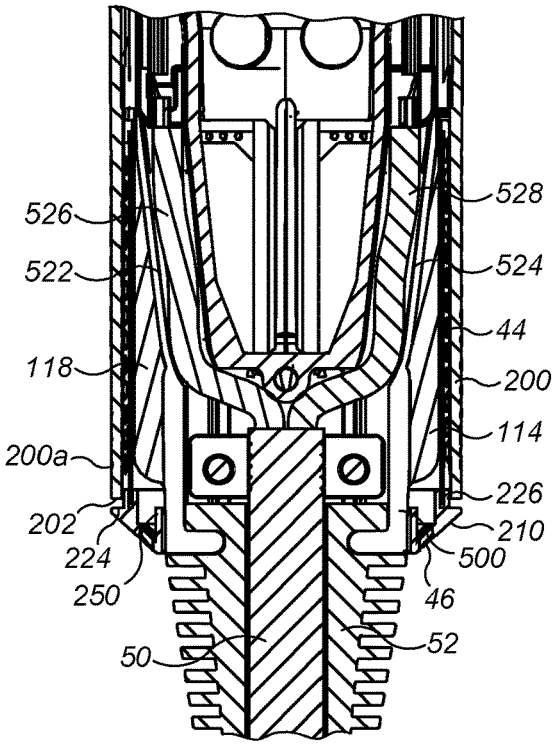
FIG. 3*b* shows an enlarged cross section of the inlet area of FIG. 3*a;*
Figure 4:
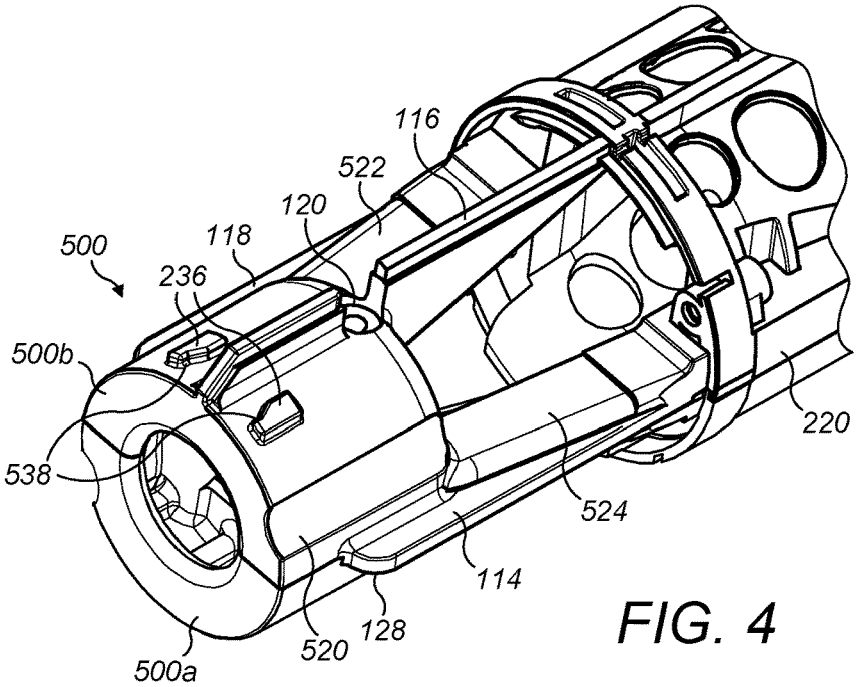
FIG. 4 shows an isometric view of the inner structure of the hairdryer shown in FIG. 2.
Figure 5A:
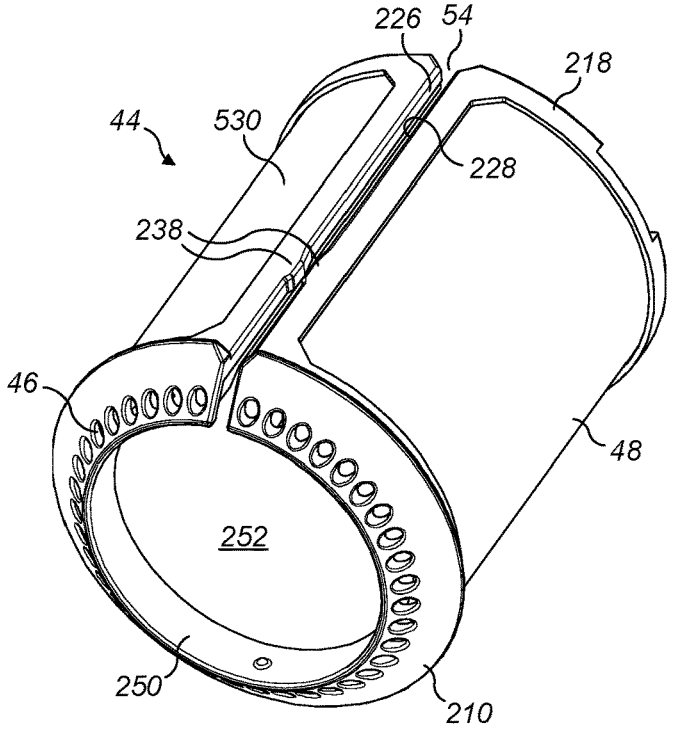
FIG. 5*a* shows an isometric view of a filter unit shown in FIG. 2.
Figure 5B:
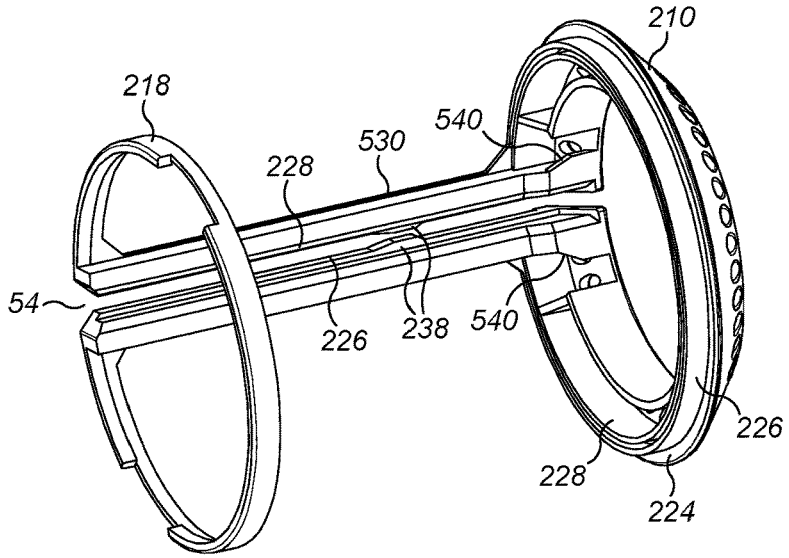
FIG. 5*b* shows an isometric view of part of the filter unit shown in FIG. 5*a;*

Referring now to FIGS. 3*b* and 4 in particular the inner structure 500 has a central hub 520 which houses the cable 50 and a pair of arms 522, 524 which house the wires 526, 528 as they are routed from the central hub 520 towards an inner wall 220 of the handle 20 of hairdryer 10.

The inner wall 220 has a greater diameter than the central hub 520 so the wires 526, 528 with the arms 522, 524 extend from the central hub 520 radially outwards towards the inner wall 220 forming a generally "Y" shaped device 500.

In this example, the inner structure 500 is formed from two parts 500*a*, 500*b* which each provide half of the central hub 520 and half of each of the two arms 522, 524. Thus, a cable 50 can be laid into one of the two parts 500*a* or 500*b* and the wires 526, 528 can be placed with respect one half of each arm 522, 524 subsequently, the other part of the inner structure 500 is attached securing the cable 50 within the central hub 520 and the wires 526, 528 within their respective arms 522, 524.

The handle 20 has a fluid inlet 40 at one end 24 through which the cable 50 passes. As the cable 50 is located approximately centrally of the handle 20, the central hub 520 of the inner structure 500 is also located centrally or in the middle of the handle 20.

In this embodiment, the inner structure 500 additionally has a structural function and has four radially spaced apart support struts 112, 114, 116, 118. A pair of the support struts 114, 118 extends from the arms 522, 524 towards the fluid inlet 40; the other pair of support struts 112, 116 extends from the central hub 520 towards the outer wall 200 of the handle 20. The outer wall 200 of the handle 20 is a thin sleeve which is supported by the inner wall 220 from the body 30 to the distal end 222 of the inner wall 220 however, as the inner wall 220 does not extend over the fluid inlet 40, the outer wall 200 is unsupported along the length of the first set of apertures 42 that extend around and along the outer wall 200. The four support struts 112, 114, 116,118 extend radially out from the central hub 520 of the inner structure 500 to contact the outer wall 200 and extend longitudinally from the distal end 222 of the inner wall 220 towards the end 24 of the handle 20.

The support struts 112, 114, 116, 118 are plate like and have rounded ends 128 to reduce the amount of material within the support struts and so minimise blocking of the first apertures 42 of the fluid inlet 40. The support struts 112, 114, 116, 118 increase the hoop strength of the handle 20 at and around the inlet 40 so if the hairdryer 10 is dropped, the support struts mitigate any damage that might occur. The support struts 112, 114, 116, 118 additionally protection the handle 20 from damage if the cable 50 is bent towards the handle 20.

One of the other pair of support struts 112, 116 has an additional function, to retain a filter unit within the handle 20.

Referring now to FIGS. 2, 3, 4, 5*a* and 5*b* in particular, an embodiment of the end wall will be discussed. The end wall 210 extends across the diameter of the outer wall 200 and away from the outer wall 200 forming a conical shape. Apertures 46 forming part of the fluid inlet 40 into the handle 20 are provided through the conical surface of the end wall 210. In this embodiment, a single row of apertures 46 is provided and this row extends around the end wall 210.

The end wall 210 also includes an inner wall 250. The inner wall 250 defines an aperture 252 through the end wall 210 through which the cable 50 and a cable strain relief 52 extend. The end wall 210 extends from the outer wall 200 and towards the longitudinal axis X-X of the handle and the inner wall 250 extends towards the outer wall 200 and towards the longitudinal axis X-XB of the handle 20. Thus, the end wall 210 has a cross section that is vaguely "V" shaped.

The end wall 210 has a number of uses. The end wall 210 provides part of the fluid inlet 40 into the handle 20. The end wall 210 enables access to filter media for replacement or washing. The end wall 210 seals the aperture through which the cable 50 and a cable strain relief 52 enter the handle 20 preventing fluid being drawn into the handle through the aperture 252. In addition the end wall 210 spaces the mesh filter 48 away from the apertures 42 that extend around the outer wall 200 of the handle 20. This prevents complete blockage of apertures within the mesh filter 48 by the framework that surrounds the apertures 52 of the fluid inlet 40. The distance between the outer wall 200 and the mesh filter 48 is less than 1 mm and preferably around 0.78 mm.

In this embodiment, the end wall 210 and the filter media are provided as an integrated filter unit 44. Referring in particular to FIGS. 5 *a* and 5*b*, the filter unit 44 includes a filter mesh 48, a frame 218 to support and protect the filter mesh 48 and the end wall 210. The filter mesh 48 is cylindrical and extends along and around the inside of the handle 20 and is designed to provide a secondary stage of filtration for the fluid inlet 40. For clarity, the apertures within the filter mesh have not been shown, however they are preferably hundreds of microns in diameter so fine dust is collected and prevented from passing through the motor of the fan unit 70 and the heater. A hole diameter of 250-350 microns has been found to work well with an open area of 25-30%. So, all fluid that passes through the fluid inlet 40 passes through the filter mesh 48. The filter mesh 48 is supported by a frame 218 that extends around the edges of the filter mesh 48.

In the event that the filter mesh 48 requires cleaning, the end wall 210 is pulled away from the handle 20 and the filter mesh 48 is removed from the inside of the outer wall 200. The end wall 210 is slightly spaced from the end of the handle 20 to provide purchase for a user to remove the end wall 210 and the filter unit 44 from the inside of the handle 20.

To enable removal of the filter unit 44 from the cable 50, the filter unit 44 is not a complete circle; it is formed with a gap 54 extending along the length of the filter unit 44. The filter mesh 48, frame 218 and end wall 210 are flexible so they can be manipulated around the cable 50 to enable washing of the filter mesh 48 or replacement of the filter unit 44.

The filter unit 44 is located within the outer wall 200 of the handle 20 and is held in this position via three locating features. A first locating feature 530 extends longitudinally along the frame and is used to locate the filter unit 44 with respect to the longitudinal axis of the handle. Second 532 and third 534 locating features are used to retain the filter unit 44 circumferentially.

The first locating feature 530 is formed from the frame 218 and support strut 116. The two edges 226, 228 of the frame that define the gap 54 and extend longitudinally along the filter mesh 48 are not straight and parallel for the whole of the gap 54. Each of the two edges 226, 228 has a protrusion 238 and the protrusions are axially aligned along the length of the gap 54. The support strut 116 has a corresponding indentation or recess 120 into which the two protrusions 238 lie when the filter unit 44 is correctly located within the handle 20 in the longitudinal direction.

To brace the two edges 226, 228 against the supporting strut 116 to prevent both fluid leakage around the frame 218 and accidental removal of the filter unit 44 from the handle 20, second and third locating features are provided. These second and third locating features are adapted to push the two edges 226, 228 towards the supporting strut 116.

On the central hub 520 of the inner structure 500, two protrusions 536 are provided having an angled face 538 where the angled face 538 is directed towards the supporting strut 116 in the direction of flow through the handle 40. Thus the second and third locating features are mirror images about the longitudinal axis of the supporting strut 116.

Cooperating with angled faces 538 the protrusions 536 are another pair of angled faces 540 however these are angled oppositely so they are directed away from the supporting strut 116 in the direction of flow through the handle 40. Thus, as the filter unit 44 is pushed into the handle 20, the two pairs of angled faces 538 and 540 meet and push against each other to circularise the filter unit 44 and to push the first locating feature 530 into the indentation 120 and the hold the protrusions 238 within the indentation.

When the filter unit 44 is inserted within the outer wall 200 handle 20, the inner wall 250 seals against the inner structure 500 to prevent fluid entering the aperture 252 without passing through the fluid inlet 40.

On order to seal the end wall 210 against the outer wall 200 of the handle 20, the end wall 210 includes an outer seat 224 which extends around the end face 202 of the outer wall 200 and includes a lip 226 which is adapted to extend within the outer wall 200. This lip 226 has a further sealing surface 228 which seals against an inner surface 200*a* of the outer wall 200.

Figure 6:
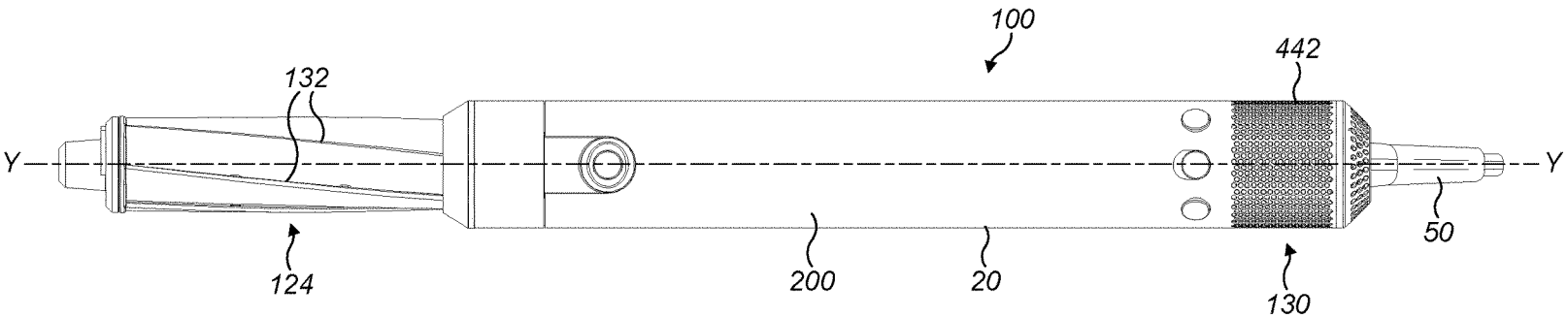
FIG. 6 shows a styling appliance according to the invention.
Figure 7:
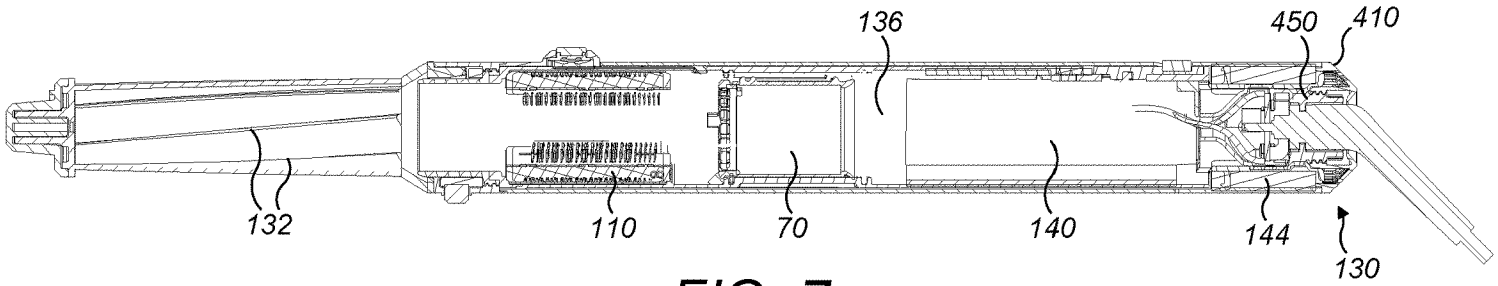
FIG. 7 shows a cross section through the appliance of FIG. 6.

FIGS. 6 and 7 show a styling appliance 100 which incorporates a heater 110. In this embodiment, components illustrated and already described in relation to FIGS. 1 and 2 have like reference numerals. This appliance 100 has a handle 20 and a styling head 124. The handle 20 has an inlet 130 at one end where fluid is drawn into the appliance through the action of a fan unit 70; the fluid flows along a fluid flow path 136 within the handle 20 and, the fluid is optionally heated by a heater 110 before entering the head 124.

The head 124 includes a plurality of radially spaced slots 132 which extend along the head 124, during a styling procedure, the hair is wrapped around the head 124 whilst hot or cool fluid passes through the hair, drying and styling the hair.

Power is supplied by a cable 50 which in this example enters the appliance 100 at the inlet 130. Internal wiring (not shown) provides power to the heater 110 and to the fan unit 70 to run a motor that drives the impeller of the fan unit 70.

In order to enable a variety of temperature and flow rates through the appliance, a PCB 140 is provided. The PCB is electrically connected to both the heater 110 and the fan unit 70 and can vary the power supplied to both. As an example, a user can chose a combination of different flow and heat settings.

Figure 8:
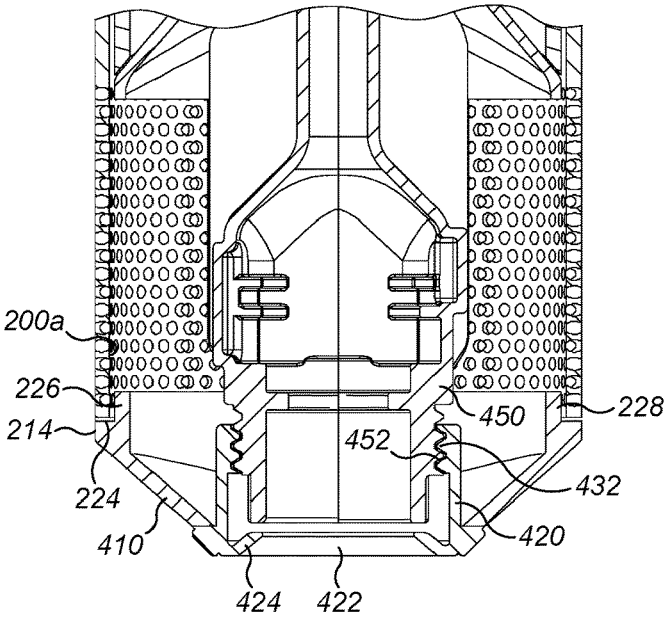
FIG. 8 shows an enlarged cross section of the inlet area of FIG. 7.
Figure 9:
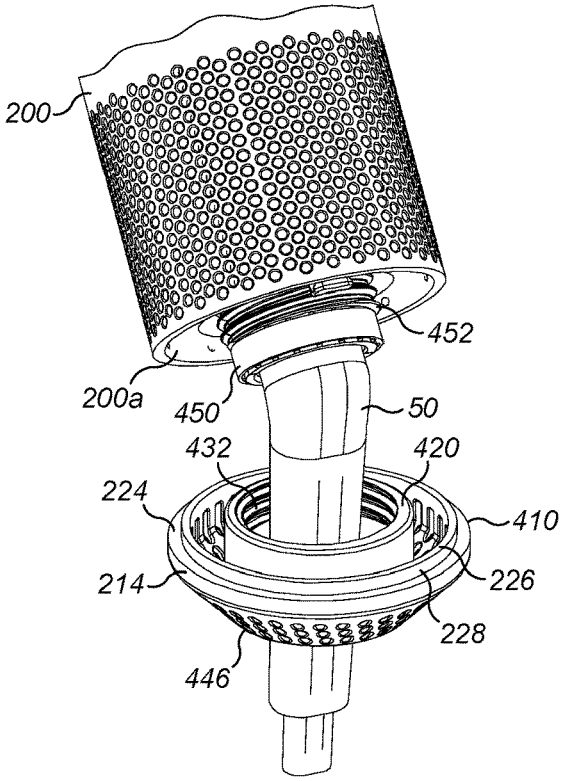
FIG. 9 shows an internal isometric view of the end wall shown in FIG. 7.
Figure 10:
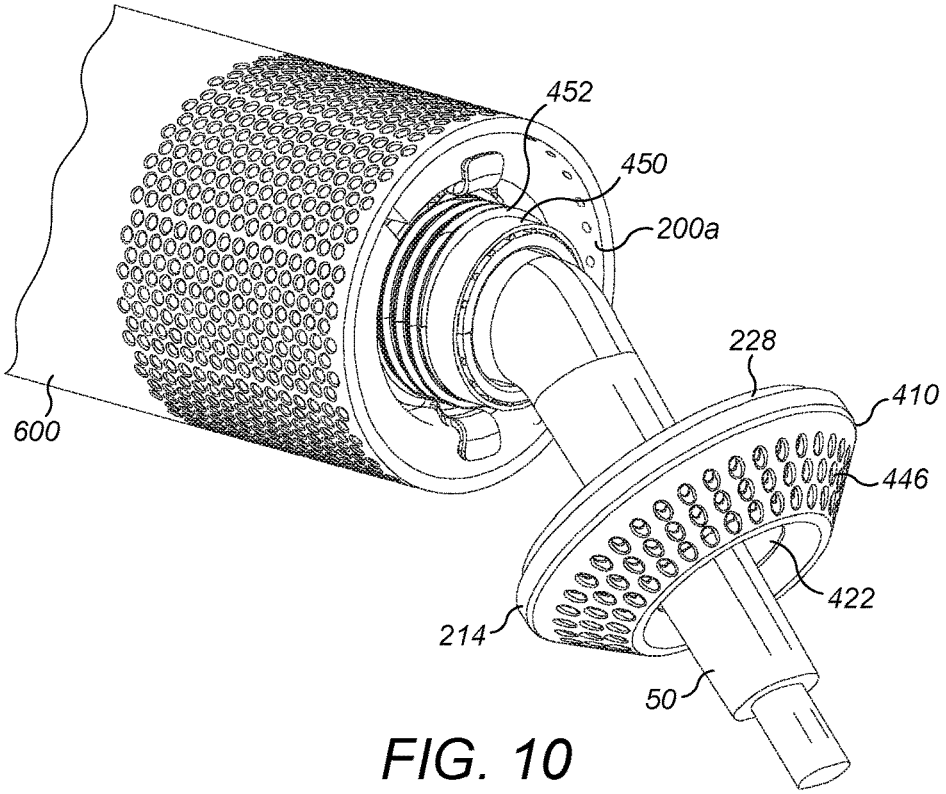
FIG. 10 shows an internal isometric view of the handle shown in FIG. 7.

Referring now to FIGS. 8, 9 and 10 in particular the inlet 130 will be discussed in greater detail. The end wall 410 extends across the diameter of the outer wall 200 and away from the outer wall 200 forming a conical shape. Apertures 446 forming part of the fluid inlet 442 into the handle 20 are provided through the conical surface of the end wall 410. In this embodiment, three rows of apertures 446 are provided and each row extends around the end wall 410.

The end wall 410 also includes an inner wall 420. The inner wall 420 defines an aperture 422 through the end wall 410 through which the cable 50 extends. The end wall 410 extends from the outer wall 200 of the handle 20 and towards the longitudinal axis Y-Y of the handle. Thus, the end wall 410 has a cross section that is asymmetrically "V" shaped. In this embodiment, a lip 424 extends from the end wall 410 around the aperture 422 providing a seal against the cable 50 and support for the cable 50.

The end wall 410 has a number of uses. The end wall 410 provides part of the fluid inlet 442 into the handle 20. The end wall 410 enables access to a filter 144 for removal of the filter either to be replaced or washed and subsequently replaced within the handle 20. The end wall 410 may additionally seal the aperture 422 through which the cable 50 enters the handle 20 preventing fluid being drawn into the handle through the aperture 422.

The end wall 410 is attached to the inner structure 450 via a screw thread 432. When the end wall 410 is fitted to the handle 20, the screw thread 432 cooperates which a corresponding screw thread 452 on the outer surface of the inner structure 450. Rotation of the end wall 420 attaches the end wall 420 to the inner structure 450 via the cooperating screw threads 432, 452.

The end wall 410 has a similar sealing arrangement against the outer wall 200 of the handle 20 as previously described. The end wall 210 includes an external wall 214 which forms a part of the external surface of the handle 20 and essentially lies parallel to the outer wall 200. An outer seat 224 is orthogonal to this external wall 214 and includes a lip 226 which is adapted to extend within the outer wall 200. This lip 226 has a further sealing surface 228 which seals against an inner surface 200*a* of the outer wall 200.

Figure 11:
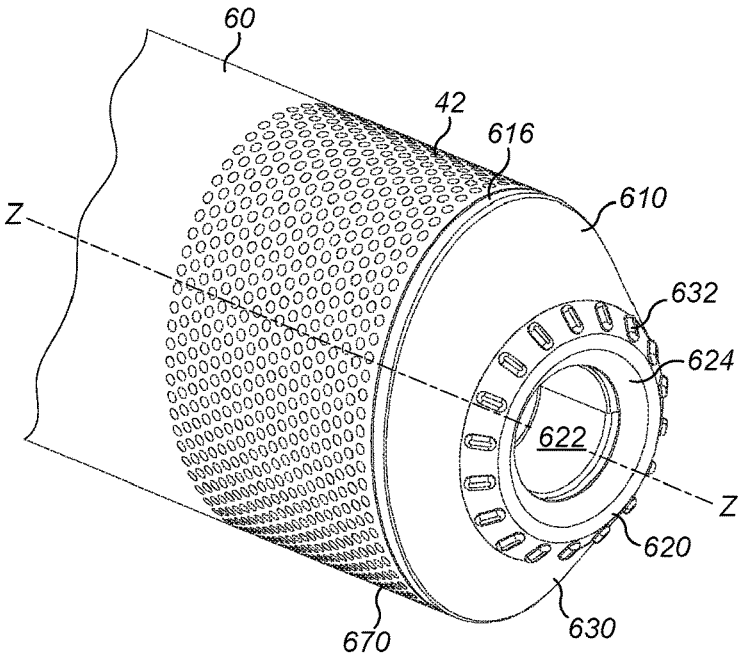
FIG. 11 shows an alternative inlet for an appliance.
Figure 12:
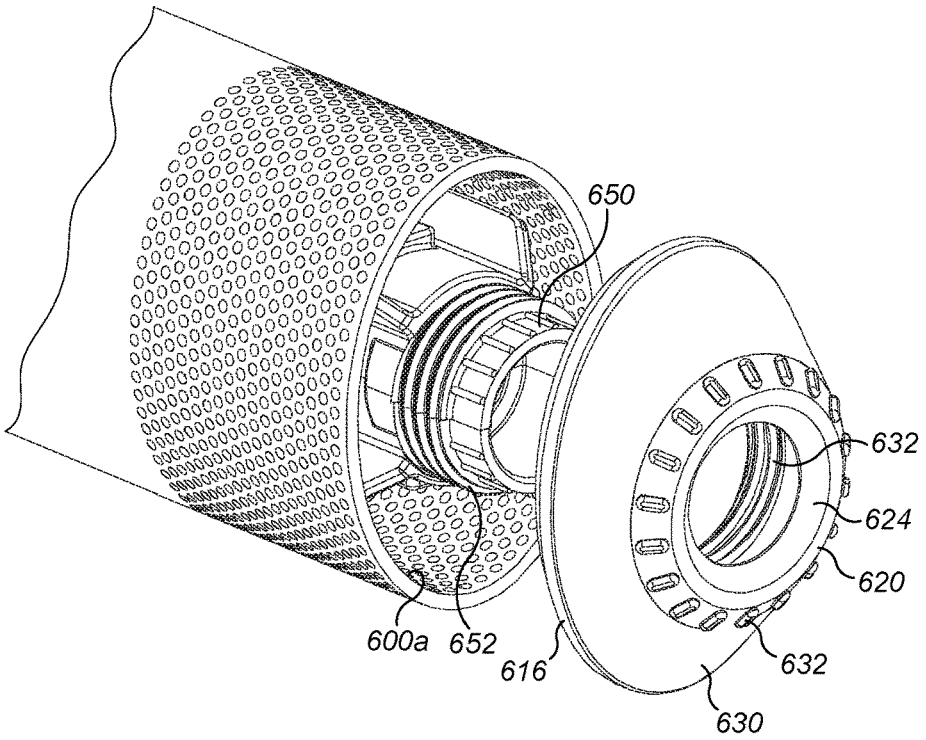
FIG. 12 shows an internal isometric view of the handle shown in FIG. 11.
Figure 13:
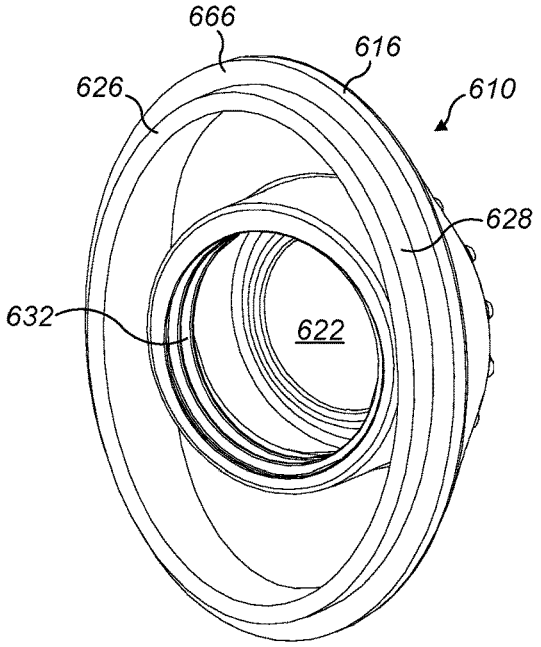
FIG. 13 shows an internal isometric view of the end wall shown in FIG. 11.

FIGS. 11 to 13 show an alternative inlet according to the invention. The handle 60 is oval in cross-section. The end wall 610 is attached to the inner structure 650 by rotation of the end wall 610 with respect to the inner structure 450. The end wall 610 has two parts an inner circular part 620 and an outer oval part 630. The inner circular part 620 engages with the inner structure 650 and is rotated to attach the end wall 610 to the inner structure 650. The inner circular part 620 also rotates with respect to the outer oval part 630.

The end wall 610 extends across the outer wall 200 and away from the outer wall 200 forming a conical shape.

The end wall 610 includes an inner wall 620. The inner wall 620 defines an aperture 622 through the end wall 610 through which a cable (not shown) extends. The end wall 610 extends from the outer wall 600 of the handle 60 and towards the longitudinal axis Z-Z of the handle. Thus, the end wall 610 has a cross section that is asymmetrically "V" shaped. In this embodiment, a lip 624 extends from the end wall 610 around the aperture 622 providing a seal against a cable and support for the cable (not shown).

The end wall 610 is attached to the inner structure 650 via a screw thread 632. When the end wall 610 is fitted to the handle 20, the screw thread 632 cooperates which a corresponding screw thread 652 on the outer surface of the inner structure 650. Rotation of the inner circular part 620 attaches the end wall 610 to the inner structure 650 via the cooperating screw threads 632, 652.

The end wall 610 has a similar sealing arrangement against the outer wall 600 of the handle 60 as previously described. The end wall 610 includes an external wall 616 which forms a part of the external surface of the handle 60 and essentially lies parallel to the outer wall 600. An outer seat 666 is orthogonal to this external wall 616 and includes a lip 626 which is adapted to extend within the outer wall 600. This lip 626 has a further sealing surface 628 which seals against an inner surface 600*a* of the outer wall 600.

In order to attach the end wall 600 to the handle 60, the outer oval part 630 is pushed against the handle to engage the lip 626 within the outer wall 600. The outer oval part 630 has two orientations in which it will engage the outer wall 600. Once the outer oval part 630 is in place, the inner circular part 620 is rotated. Grips 632 are provided on the inner circular part 620 to assist in the rotation.

In this embodiment the fluid inlet 670 is only formed from apertures 42 in the outer wall 600 however, apertures could be formed in the outer oval part 630 as previously described. In the embodiments disclosed with respect to FIGS. 1 to 10, the end wall 210, 410 may be formed without apertures forming part of the fluid inlet.

In the embodiment described with respect to FIGS. 6 to 13, the end wall 410, 610 may form part of a filter unit as previously described.

The inner wall 220,420, 624 guides and supports the cable 50. The inner wall 220,420, 624 allows the cable 50 to flex and move with respect to the handle 20, 600 without causing a sharp bend or turn in the cable which could damage the cable 50.

The invention has been described in detail with respect to a hairdryer and a hot styling appliance however, it is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A hand held appliance comprising a housing having an outer wall, an inner structure disposed within the outer wall, and an end wall extending across the outer wall, wherein the end wall comprises an inner wall that attaches the end wall to the housing via the inner structure, the end wall comprises apertures that form at least part of a fluid inlet into the appliance and at least a portion of the apertures are located between the inner wall and an outer periphery of the end wall, and the inner structure is housed within the outer wall and spaced from the outer wall.

2. The appliance of claim 1, wherein the end wall comprises a plurality of apertures that extend at least partially around the end wall.

3. The appliance of claim 1, wherein the end wall is rotated with respect to the inner structure to attach the end wall to the inner structure.

4. The appliance of claim 1, wherein the end wall extends away from the outer wall.

5. The appliance of claim 1, wherein the housing has a longitudinal axis along which the outer wall extends.

6. The appliance of claim 5, wherein the end wall extends away from the outer wall towards the longitudinal axis.

7. The appliance of claim 5, wherein the end wall extends from the outer wall towards the longitudinal axis as the end wall extends away from the outer wall.

8. The appliance of claim 1, wherein the end wall tapers as it extends away from the outer wall.

9. The appliance of claim 8, wherein the end wall is frustoconical in shape.

10. The appliance of claim 1, wherein the end wall is formed from two parts, a first part which engages with the inner structure and a second part which is held against the outer wall by the first part.

11. The appliance of claim 10, wherein the first part is rotatable relative to the second part.

12. The appliance of claim 10, wherein the first part is rotatable relative to the inner structure to engage the end wall with respect to the housing.

13. The appliance of claim 10, wherein the housing has an oval cross-section.

14. The appliance of claim 1, wherein the inner wall extends from the end wall to engage with a cooperating attachment member of the inner structure.

15. The appliance of claim 14, wherein one of the inner wall and cooperating member comprises a groove into which a cooperating protrusion of the other of the inner wall and cooperating member extends when the end wall is attached to the inner structure of the appliance.

16. The appliance of claim 15, wherein the groove is helical.

17. The appliance of claim 1, wherein the end wall is pushed towards the handle to attach the end wall to the inner structure.

18. The appliance of claim 1, wherein the end wall comprises an outer edge and when the end wall has been attached to the inner structure, the outer edge is adjacent to the outer wall or abuts the outer wall.

19. The appliance of claim 1, wherein the end wall comprises a lip that extends inside the outer wall when the end wall is attached.

20. The appliance of claim 18, wherein the outer edge forms a mating face for an end face of the outer wall.

21. The appliance of claim 1, wherein the outer edge of the end wall extends across the end wall of the handle so an outer diameter of the handle is substantially the same as that of the end wall where the end wall meets the outer wall.

22. The appliance of claim 1, wherein the housing is a handle.

23. The appliance of claim 1, wherein the appliance is a hair care appliance.

24. The appliance of claim 23, wherein the hair care appliance is a hairdryer.

25. The appliance of claim 23, wherein the hair care appliance is a hot styling appliance.

* * * * *